US006351912B1

(12) United States Patent
Weder

(10) Patent No.: US 6,351,912 B1
(45) **Date of Patent: *Mar. 5, 2002**

(54) COVERING FOR FLOWER POT AND FLORAL GROUPING

(75) Inventor: Donald E. Weder, Highland, IL (US)

(73) Assignee: Southpac Trust International, Inc., Rarotonga (CK)

( * ) Notice: Subject to any disclaimer, the term of this patent is extended or adjusted under 35 U.S.C. 154(b) by 0 days.

This patent is subject to a terminal disclaimer.

(21) Appl. No.: 08/433,109

(22) Filed: May 3, 1995

Related U.S. Application Data

(62) Division of application No. 08/183,010, filed on Jan. 14, 1994, which is a continuation of application No. 08/001,001, filed on Jan. 6, 1993, now Pat. No. 5,307,606.

(51) Int. Cl.[7] ..... A47G 7/08
(52) U.S. Cl. ..... 47/76
(58) Field of Search ..... 323/4, 11; 47/72, 47/84, 84 B, 84 BC

(56) References Cited

U.S. PATENT DOCUMENTS

| | | | | |
|---|---|---|---|---|
| 524,219 | A | 8/1894 | Schmidt | |
| 732,889 | A | 7/1903 | Paver | |
| 950,785 | A | 3/1910 | Pene | |
| 1,063,154 | A | 5/1913 | Bergen | |
| 1,446,563 | A | 2/1923 | Hughes | |
| 1,520,647 | A | 12/1924 | Hennegan | |
| 1,525,015 | A | 2/1925 | Weeks | |
| 1,610,652 | A | 12/1926 | Bouchard | |
| 1,697,751 | A | 1/1929 | Blake | 229/87 |
| 1,863,216 | A | 6/1932 | Wordingham | |
| 1,978,631 | A | 10/1934 | Herrlinger | 91/68 |
| 2,048,123 | A | 7/1936 | Howard | 229/87 |
| RE21,065 | E | 5/1939 | Copeman | 93/2 |
| 2,170,147 | A | 8/1939 | Lane | 206/56 |
| 2,278,673 | A | 4/1942 | Savada et al. | 154/43 |
| 2,302,259 | A | 11/1942 | Rothfuss | 41/10 |
| 2,323,287 | A | 7/1943 | Amberg | 229/53 |

(List continued on next page.)

FOREIGN PATENT DOCUMENTS

| | | | | |
|---|---|---|---|---|
| AU | 42319 | * | 7/1978 | 47/72 |
| AU | 4231978 | | 6/1979 | |
| BE | 654427 | | 1/1965 | |
| CH | 560532 | | 4/1975 | |
| DE | 345464 | | 12/1921 | |
| DE | 513971 | | 11/1930 | |
| DE | 1166692 | | 3/1964 | |
| DE | 2060812 | | 11/1971 | |
| DE | 3911847 | | 10/1990 | 47/72 |

(List continued on next page.)

OTHER PUBLICATIONS

Speed Cover Brochure, "The Simple Solution For Those Peak Volume Periods", Highland Supply Corporation, ©1989.
"Speed Sheets and Speed Rolls" Brochure, Highland Supply Corporation, ©1990.
"Color Them Happy with Highlander Products" ©1992.
"Costa Keeps the Christmas Spirit", Supermarket Floral, Sep. 15, 1992.
"Super Seller", Supermarket Floral, Sep. 15, 1992. FloraTrop Inc.

(List continued on next page.)

*Primary Examiner*—Peter M. Poon
*Assistant Examiner*—Jeffrey L. Gellner
(74) *Attorney, Agent, or Firm*—Dunlap, Codding & Rogers, P.C.

(57) ABSTRACT

A cover for use with a flower pot having a floral grouping disposed therein. The cover includes a sheet of material having a sheet extension connected to an outer peripheral surface thereof. The sheet of material is formed into a pot cover for covering the flower pot and the sheet extension extends over the floral grouping.

64 Claims, 2 Drawing Sheets

U.S. PATENT DOCUMENTS

| | | | | | |
|---|---|---|---|---|---|
| 2,355,559 | A | | 8/1944 | Renner | 229/8 |
| 2,371,985 | A | | 3/1945 | Freiberg | 206/46 |
| 2,411,328 | A | | 11/1946 | MacNab | 33/12 |
| 2,510,120 | A | | 6/1950 | Leander | 117/122 |
| 2,529,060 | A | | 11/1950 | Trillich | 117/68.5 |
| 2,621,142 | A | | 12/1952 | Wetherell | 154/117 |
| 2,648,487 | A | | 8/1953 | Linda | 229/55 |
| 2,774,187 | A | * | 12/1956 | Smithers | 47/84 |
| 2,822,287 | A | | 2/1958 | Avery | 117/14 |
| 2,846,060 | A | | 8/1958 | Yount | 206/58 |
| 2,850,842 | A | | 9/1958 | Eubank, Jr. | 47/58 |
| 2,883,262 | A | | 4/1959 | Borin | 21/56 |
| 2,989,828 | A | * | 6/1961 | Warp | 47/72 |
| 3,022,605 | A | * | 2/1962 | Reynolds | 47/84 B |
| 3,094,810 | A | | 6/1963 | Kalpin | 47/37 |
| 3,121,647 | A | | 2/1964 | Harris et al. | 118/202 |
| 3,130,113 | A | | 4/1964 | Silman | 161/97 |
| 3,202,193 | A | * | 8/1965 | Ware | 383/4 |
| 3,271,922 | A | | 9/1966 | Wallerstein et al. | 53/3 |
| 3,322,325 | A | | 5/1967 | Bush | 229/62 |
| 3,376,666 | A | | 4/1968 | Leonard | 47/41 |
| 3,380,646 | A | | 4/1968 | Doyen et al. | 229/57 |
| 3,431,706 | A | * | 3/1969 | Stuck | 47/72 |
| 3,508,372 | A | | 4/1970 | Wallerstein et al. | 53/3 |
| 3,510,054 | A | | 5/1970 | Sanni et al. | 229/66 |
| 3,552,059 | A | | 1/1971 | Moore | 47/41.12 |
| 3,554,434 | A | | 1/1971 | Anderson | 229/55 |
| 3,556,389 | A | | 1/1971 | Gregoire | 229/53 |
| 3,557,516 | A | | 1/1971 | Brandt | 53/14 |
| 3,620,366 | A | | 11/1971 | Parkinson | 206/59 |
| 3,681,105 | A | | 8/1972 | Milutin | 117/15 |
| 3,767,104 | A | | 10/1973 | Bachman et al. | 229/7 |
| 3,793,799 | A | | 2/1974 | Howe | 53/32 |
| 3,869,828 | A | | 3/1975 | Matsumoto | 47/34.11 |
| 3,888,443 | A | | 6/1975 | Flanigen | 248/152 |
| 3,962,503 | A | | 6/1976 | Crawford | 428/40 |
| 4,043,077 | A | | 8/1977 | Stonehocker | 47/66 |
| 4,054,697 | A | | 10/1977 | Reed et al. | 428/40 |
| 4,091,925 | A | | 5/1978 | Griffo et al. | 206/423 |
| 4,113,100 | A | | 9/1978 | Soja et al. | 206/602 |
| 4,118,890 | A | | 10/1978 | Shore | 47/28 |
| 4,189,868 | A | | 2/1980 | Tymchuck et al. | 47/84 |
| 4,216,620 | A | | 8/1980 | Weder et al. | 47/72 |
| D259,333 | S | | 5/1981 | Charbonneau | D9/306 |
| 4,280,314 | A | | 7/1981 | Stuck | 53/241 |
| 4,297,811 | A | | 11/1981 | Weder | 47/72 |
| 4,333,267 | A | * | 6/1982 | Witte | 47/72 |
| 4,347,686 | A | | 9/1982 | Wood | 47/73 |
| 4,380,564 | A | | 4/1983 | Cancio et al. | 428/167 |
| 4,400,910 | A | | 8/1983 | Kovdstaal et al. | 47/84 |
| 4,413,725 | A | * | 11/1983 | Bruno et al. | 47/72 |
| D279,279 | S | | 6/1985 | Wagner | D11/143 |
| 4,546,875 | A | | 10/1985 | Zweber | 206/0.82 |
| 4,621,733 | A | | 11/1986 | Harris | 206/423 |
| 4,640,079 | A | | 2/1987 | Stuck | 53/390 |
| 4,717,262 | A | | 1/1988 | Roen et al. | 383/120 |
| 4,733,521 | A | | 3/1988 | Weder et al. | 53/580 |
| 4,765,464 | A | | 8/1988 | Ristvedt | 206/0.82 |
| 4,771,573 | A | | 9/1988 | Stengel | 47/67 |
| 4,773,182 | A | | 9/1988 | Weder et al. | 47/72 |
| 4,801,014 | A | | 1/1989 | Meadows | 206/423 |
| 4,810,109 | A | | 3/1989 | Castel | 383/105 |
| 4,835,834 | A | | 6/1989 | Weder | 29/525 |
| D301,991 | S | | 7/1989 | Van Sant | D11/149 |
| 4,941,572 | A | | 7/1990 | Harris | 206/423 |
| 4,980,209 | A | | 12/1990 | Hill | 428/34.1 |
| 5,073,161 | A | | 12/1991 | Weder et al. | 493/154 |
| 5,074,675 | A | | 12/1991 | Osgood | 383/122 |
| 5,105,599 | A | | 4/1992 | Weder | 53/399 |
| 5,111,638 | A | | 5/1992 | Weder | 53/397 |
| 5,120,382 | A | | 6/1992 | Weder | 156/212 |
| 5,152,100 | A | | 10/1992 | Weder et al. | 47/72 |
| 5,181,364 | A | | 1/1993 | Weder | 53/397 |
| D335,105 | S | | 4/1993 | Ottenwälder et al. | D11/164 |
| 5,199,242 | A | | 4/1993 | Weder et al. | 53/397 |
| 5,205,108 | A | | 4/1993 | Weder et al. | 53/397 |
| 5,228,234 | A | | 7/1993 | de Klerk et al. | 47/41.01 |
| 5,235,782 | A | * | 8/1993 | Landau | 47/72 |
| 5,239,775 | A | * | 8/1993 | Landau | 47/72 |
| 5,249,407 | A | | 10/1993 | Stuck | 53/399 |
| 5,259,106 | A | | 11/1993 | Weder et al. | 29/469.5 |
| 5,307,606 | A | * | 5/1994 | Weder | 53/410 |
| 5,315,785 | A | | 5/1994 | Avôt et al. | 47/72 |
| 5,361,482 | A | | 11/1994 | Weder et al. | 29/469 |
| 5,388,695 | A | | 2/1995 | Gilbert | 206/423 |
| 5,464,286 | A | * | 11/1995 | Stevens | 383/11 |
| 5,496,251 | A | | 3/1996 | Cheng | 493/224 |
| 5,496,252 | A | | 3/1996 | Gilbert | 493/224 |
| 5,647,168 | A | | 7/1997 | Gilbert | 47/72 |
| 6,061,958 | A | * | 5/2000 | Weder | 47/72 |
| 6,088,961 | A | * | 7/2000 | Weder | 47/72 |
| 6,148,561 | A | * | 11/2000 | Weder | 47/72 |
| 6,192,625 | B1 | * | 2/2001 | Weder | 47/72 |
| 6,192,626 | B1 | * | 2/2001 | Weder | 47/72 |

FOREIGN PATENT DOCUMENTS

| | | | | |
|---|---|---|---|---|
| EP | 0050990 | | 5/1982 | |
| FR | 1376047 | | 9/1964 | |
| FR | 2036163 | * | 12/1970 | 47/72 |
| FR | 2137325 | | 12/1972 | |
| FR | 2272914 | | 1/1976 | |
| FR | 2489126 | | 3/1982 | |
| FR | 2610604 | | 8/1988 | |
| GB | 1204647 | | 9/1970 | |
| GB | 2056410 | | 3/1981 | |
| GB | 2074542 | * | 11/1981 | 47/72 |
| GB | 2128083 | | 4/1984 | |
| GB | 2252708 | | 8/1992 | |
| IT | 224507 | | 4/1996 | |
| JP | 542958 | | 2/1993 | |
| NL | 8301709 | | 12/1984 | |
| NL | 1000658 | | 6/1995 | |
| WO | 9315979 | | 8/1993 | |

OTHER PUBLICATIONS

"Halloween", Link Magazine, Sep. 1992, 2 pages.

"Now More Than Ever", Supermarket Floral, Sep. 15, 1992. Hana Bay Flowers.

Le Plant Sac Advertisement, published prior to Sep. 26, 1987.

"The Simple Solution For Those Peak Volume Periods", Brochure, Highland Supply Corporation, 1989.

"Speed Sheets and Speed Rolls", Brochure, Highland Supply Corporation, 1990.

* cited by examiner

COVERING FOR FLOWER POT AND FLORAL GROUPING

CROSS-RELATED REFERENCES

This is a Divisional of co-pending application Ser. No. 08/183,010 filed on Jan. 14, 1994, entitled "COVERING FOR FLOWER POT AND FLORAL GROUPING", which is a continuation of U.S. Ser. No. 08/001,001 now U.S. Pat. No. 5,307,606 filed Jan. 6, 1993.

This invention is a continuation-in-part of U.S. Ser. No. 968,798, filed Oct. 30, 1992, entitled, "METHOD FOR WRAPPING AN OBJECT WITH A MATERIAL HAVING PRESSURE SENSITIVE ADHESIVE THEREON", which is a continuation of U.S. Ser. No. 865,563, filed May 21, 1992, entitled, METHOD FOR WRAPPING AN OBJECT WITH A MATERIAL HAVING PRESSURE SENSITIVE ADHESIVE THEREON, which is a continuation of U.S. Ser. No. 649,379, filed Jan. 31, 1991, now U.S. Pat. No. 5,111,638, issued May 12, 1992, entitled, METHOD FOR WRAPPING AN OBJECT WITH A MATERIAL HAVING PRESSURE SENSITIVE ADHESIVE THEREON, which is a continuation of U.S. Ser. No. 249,761, filed Sep. 26, 1988, now abandoned, which is a continuation-in-part of U.S. Ser. No. 219,083, filed Jul. 13, 1988, now U.S. Pat. No. 4,897,031, issued Jan. 30, 1990.

FIELD OF THE INVENTION

The present invention relates generally to coverings for flower pots and, more particularly, but not by way of limitation, to a covering for a flower pot having a sheet extension for extending about a floral grouping disposed in the flower pot.

DESCRIPTION OF THE PREFERRED EMBODIMENTS

Figure 1:
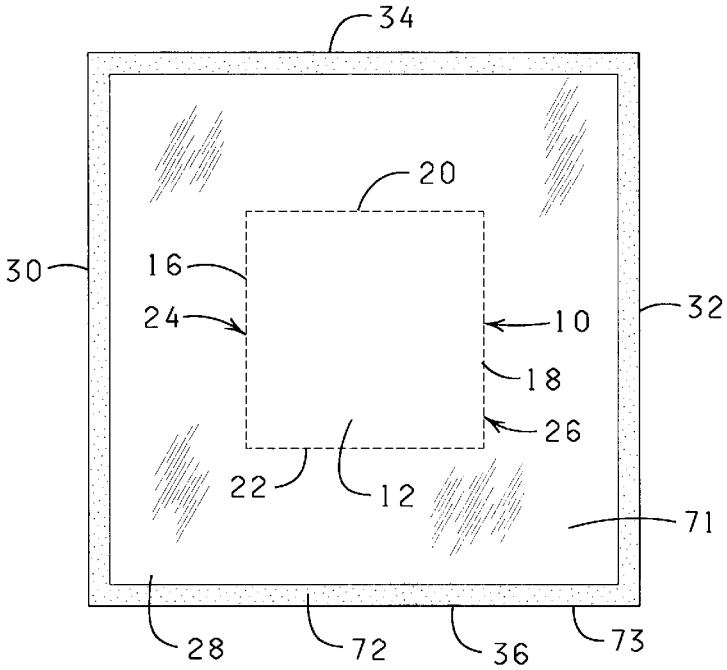
FIG. 1 is a plan view of a sheet of material with a sheet extension connected thereto constructed in accordance with the present invention.

Referring to FIG. 1, as shown therein and designated by the general reference numeral 10 is a sheet of material constructed in accordance with the present invention. The sheet of material 10 shown in FIG. 1 has an upper surface 12, a lower surface 14 (FIG. 3), a first end 16, a second end 18, a first side 20 and a second side 22. The ends 16 and 18 cooperate with the sides 20 and 22 to define an outer perimeter 24 of the sheet of material 10. The outer perimeter surface 24 of the sheet of material 10 is defined by perforations 26, as shown in FIGS. 1, 3 and 4.

Figure 3:
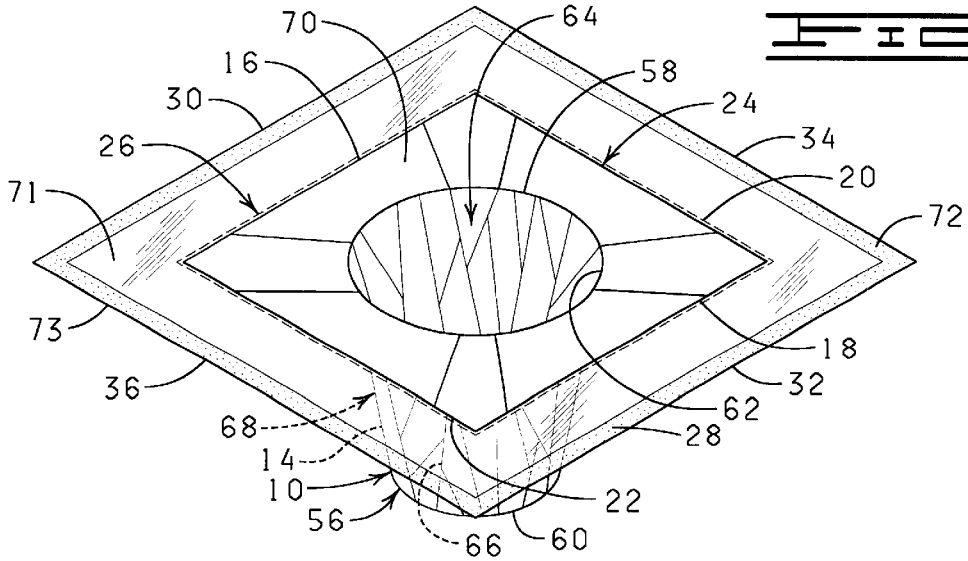
FIG. 3 is a perspective view of the sheet of material formed into a pot cover with the sheet extension connected thereto.
Figure 4:
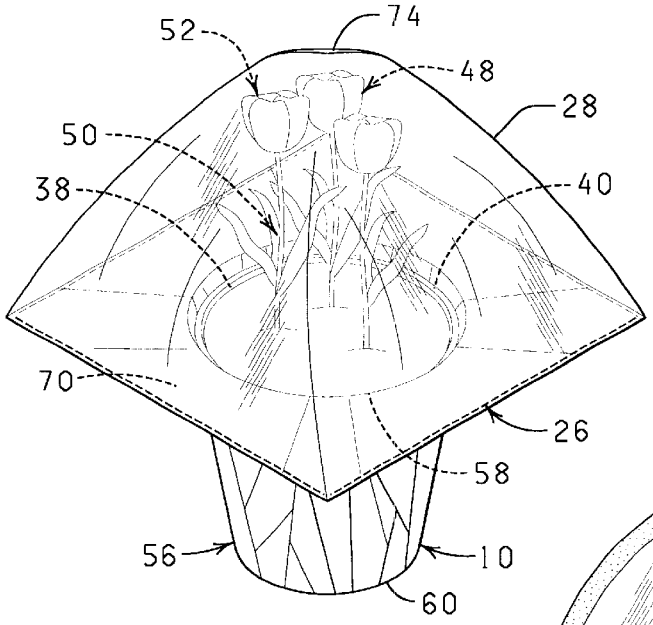
FIG. 4 is a perspective view showing the flower pot of FIG. 2 disposed in the pot cover of FIG. 3 with the sheet extension formed about the floral grouping.

As shown in FIGS. 1, 3 and 4, a sheet extension 28 is connected to the outer perimeter 24 of the sheet of material 10. As shown in FIGS. 1 and 3, the sheet extension 28 extends a distance outwardly from the outer perimeter 24 of the sheet of material 10. The sheet extension 28 has a first end 30, a second end 32, a first side 34 and a second side 36. A portion of the sheet extension 28 extends a distance outwardly from the first end 16 of the sheet of material 10 terminating with the first end 30 of the sheet extension 28. Another portion of the sheet extension 28 extends a distance outwardly from the second end 18 of the sheet of material 10 terminating with the second end 32 of the sheet extension 28. Yet another portion of the sheet extension 28 extends a distance outwardly from the first side 20 of the sheet of material 10 terminating with the first side 34 of the sheet extension 28. Still another portion of the sheet extension 28 extends a distance outwardly from the second side 22 of the sheet of material 10 terminating with the second side 36 of the sheet extension 28.

The sheet extension 28 cooperates with the sheet of material 10 to define a generally square or rectangularly shaped sheet with the perforations 26 being disposed in a central portion of the sheet and defining the outer perimeter 24 of the sheet of material 10. Preferably, the sheet of material 10 and the sheet extension 28 are unitary and formed from a single sheet or plies or multiple sheets one on top of the other which may or may not be laminated.

The sheet of material 10 and the sheet extension 28 are constructed from any suitable flexible material that is capable of being wrapped about a floral grouping and formed into the covering, as described herein. Preferably, the sheet of material 10 and the sheet extension 28 are constructed of a material selected from a group of materials consisting of paper, metal foil, cloth (natural or synthetic), denim, burlap or polymer film or combinations thereof.

The term "polymer film" as used herein means any polymer film. For example, but not by way of limitation, one polymer film is a polypropylene film. Another example of a polymer film, but not by way of limitation, is cellophane.

The sheet of material 10 and the sheet extension 28 have a thickness in a range from about 0.1 mil to about 30 mil. Preferably, the sheet of material 10 and the sheet extension 28 have a thickness in a range from about 0.1 mil to about 5 mil.

The sheet of material 10 and the sheet extension 28 may be any shape and a rectangular shape is shown in FIG. 1 only by way of example. The sheet of material 10 and the sheet extension 28 for example only may be square, rectangular, circular or any other geometric shape such as heart shaped for example only.

The sheet of material 10 and the sheet extension 28 may be constructed of a single layer of material or a plurality of layers of the same or different types of materials. Any thickness of the sheet of material 10 and the sheet extension 28 may be utilized in accordance with the present invention as long as the sheet of material 10 and the sheet extension 28 are wrappable about a floral grouping and formable into the covering, as described herein. The layers of material comprising the sheet of material 10 and the sheet extension 28 may be connected together or laminated or may be separate layers.

Figure 2:
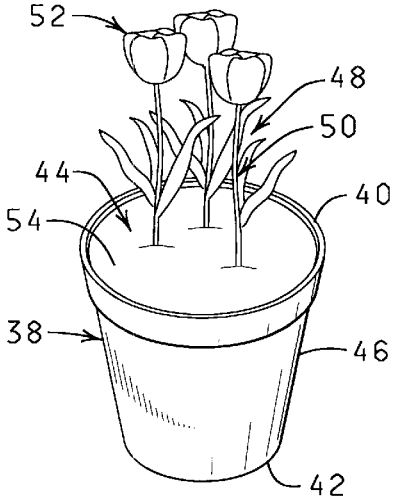
FIG. 2 is a perspective view of a flower pot having a floral grouping disposed therein.

The covering of the present invention is particularly constructed to be used with a pot 38 (FIG. 2). The pot 38 has a top 40, a bottom 42 with an opening through the top 40 forming a receiving space 44 within the pot 38. The pot 38 also has an outer peripheral surface 46. As shown in FIG. 2, the pot 38 is generally cylindrically shape. However, the pot 38 may be any shape as may be desired in a particular application.

A floral grouping 48 is disposed at least partially within the receiving space 44 of the pot 38, as shown in FIG. 2. The floral grouping 48 has a stem end 50 and a bloom end 52. In one embodiment as shown in FIG. 2, material such as soil 54 is disposed in the receiving space 44 and a portion of the stem end 50 extends into the soil 54. The floral grouping extends a distance upwardly from the top 40 of the pot 38 terminating with the bloom end 52.

"Floral grouping" as used herein means cut fresh flowers, artificial flowers, a single flower, other fresh and/or artificial plants or other floral materials and may include other secondary plants and/or ornamentation which add to the aesthetics of the overall floral grouping.

A decorative pattern, such as a color and/or an embossed pattern, and/or other decorative surface ornamentation may be applied to the upper surface 12 and/or the lower surface 14 of the sheet of material 10 or portions thereof including, but not limited to printed design, coatings, colors, flocking or metallic finishes. The sheet of material 10 also may be totally or partially clear or tinted transparent material. The sheet extension 28 is transparent, although a decorative pattern also may be applied to the sheet extension 28.

The sheet of material 10 with the sheet extension 28 connected thereto is placed between a male and a female die or other forming system and formed into a pot cover 56 (FIG. 3). As shown in FIGS. 3 and 4, the pot cover 56 has a top 58, a closed bottom 60 and a cover opening 62 (FIG. 3) formed through the top 58 and extending through the top 58 a distance toward the bottom 60 of the pot cover 56 providing a pot receiving space 64 (FIG. 3). The pot receiving space 64 is shaped and adapted to receive the pot 38.

The pot cover 56 has a plurality of overlapping folds 66 (FIG. 3) with each of the overlapping folds 66 extending at various distances and at various angles over an outer peripheral surface 68 (FIG. 3) of the pot cover 56 extending between the top 58 and the bottom 60. The overlapping folds 66 extend at various angles and over various distance over the outer peripheral surface 68.

The pot cover 56 includes a skirt 70 (FIGS. 3 and 4). The skirt 70 extends from the top 58 of the pot cover 56 radially outwardly with an outer perimeter of the skirt 70 being formed by the outer perimeter surface 24 of the sheet of material 10. The perforations 26 extend along the outer perimeter of the skirt 70 formed by the outer perimeter 24 of the sheet of material 10.

The overlapping folds 66 may be connected or at least partially connected. The connection of the overlapping folds 66 may be accomplished by using heat sealing material and heat sealing the overlapping folds 66 or by adhesively or cohesively connecting the overlapping folds.

A pot cover constructed in the manner just described with respect to the pot cover 56 and a system for forming such a pot cover is disclosed in U.S. Pat. No. 4,773,182, entitled, Article Forming System, issued to Weder, et al, Sep. 27, 1988, and the disclosure of this patent specifically hereby is incorporated herein by reference.

The pot 38 is placed in the pot receiving space 64 and positioned in the pot cover 56 such that the bottom 42 of the pot 38 is disposed generally adjacent the bottom 60 of the pot cover 56. The pot cover 56 substantially encompasses the entire outer peripheral surface 46 of the pot 38 including the bottom 42. The pot cover 56 extends from the bottom 42 to the top 40 of the pot 38. The skirt 70 extends radially outwardly from the top 40 of the pot 38.

After the pot 38 has been placed in the pot cover 56, the sheet extension 28 is formed about the floral grouping 48 to a position wherein the sheet extension 28 covers and encompasses a substantial portion of the floral grouping 48 including the bloom end 52 of the floral grouping 48.

The sheet extension 28 preferably includes a bonding material 72 (FIG. 1) disposed on an upper surface 71 of the sheet extension 28 and extending about an outer perimeter 73 of the sheet extension 28. After the sheet extension 28 has been formed about the floral grouping 48, the ends of the sheet extension 28 are bonded together to provide a closed end 74 (FIG. 4).

The term "bonding material" as used herein means an adhesive, preferably a pressure sensitive adhesive, or a cohesive. Where the bonding material is a cohesive, a similar cohesive material must be placed on the adjacent surface for bondingly contacting and bondingly engaging with the cohesive material. The term "bonding material" also includes materials which are heat sealable and, in this instance, the adjacent portions of the material must be brought into contact and then heat must be applied to effect the seal. The term "bonding material" as used herein also means a heat sealing lacquer which may be applied to the sheet of material and, in this instance, heat also must be applied to effect the sealing. The term "bonding material" as used herein means any type of material or thing which can be used to effect the bonding or connecting of the two adjacent portions of the material or sheet of material to effect the connection or bonding described herein. The term "bonding material" also includes labels, bands, ribbons, strings, tape, staples or combinations thereof.

The sheet extension 28 remains in a position extending about the floral grouping 48 until it is desired to remove the sheet extension 28. The sheet extension 28 is removed from the pot cover 56 by tearing along the perforations 26 separating the sheet extension 28 from the pot cover 56. The sheet extension 28 then is removed from the floral grouping 48 leaving the pot cover 56 providing a decorative cover for the pot 38.

In addition to the perforations 26, the sheet extension 28 also may include perforations extending between the perforations 26 and the outer perimeter 73 of the sheet extension 28 to further assist in the removal of the sheet extension 28 when it is no longer is desired to keep the sheet extension 28 extending about the floral grouping 48.

EMBODIMENT OF FIGS. 5 AND 6

Figure 5:
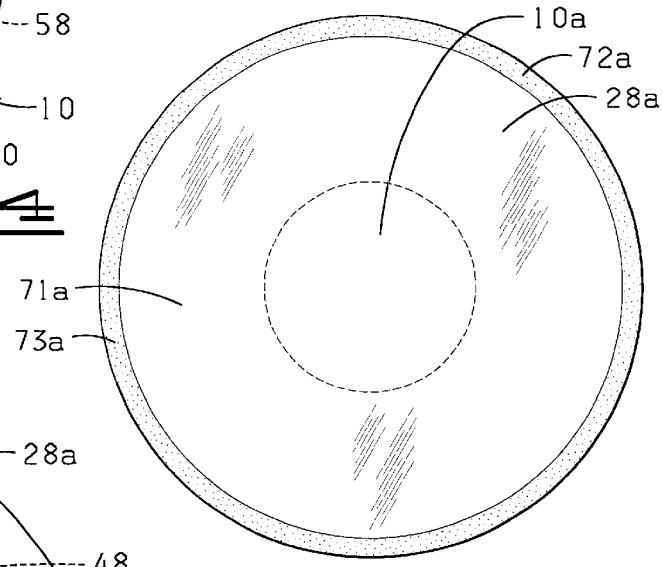
FIG. 5 is plan view of a modified sheet of material with a modified sheet extension connected thereto.
Figure 6:
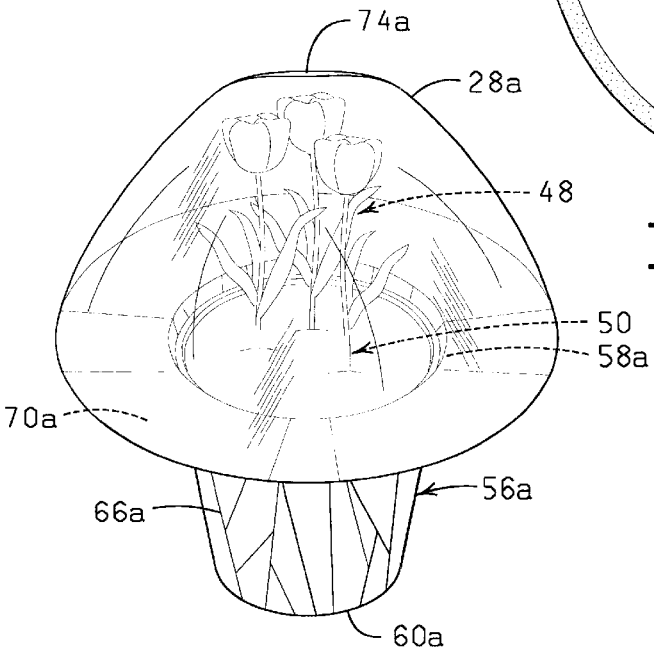
FIG. 6 is a perspective view of the sheet of material of FIG. 5 formed into the pot cover and having the flower pot of FIG. 2 disposed in the pot cover with the sheet extension formed about the floral grouping.
Figure 4:
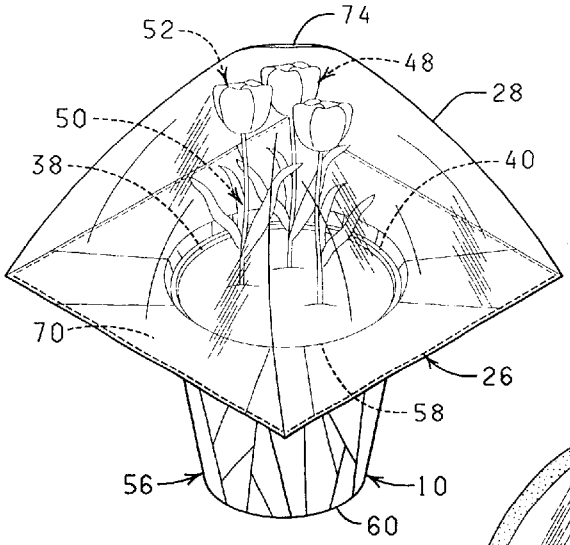
Figure 5:
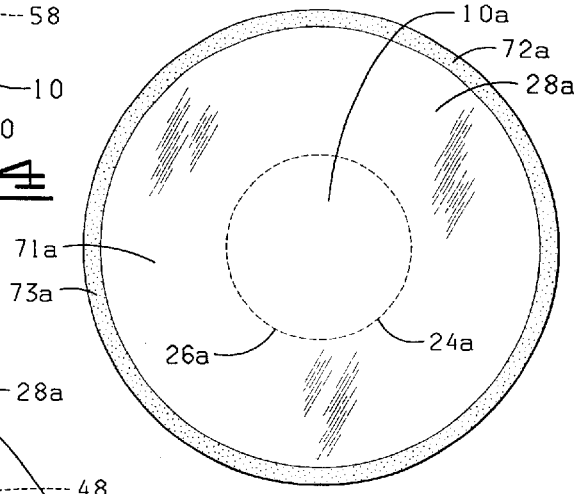
Figure 6:
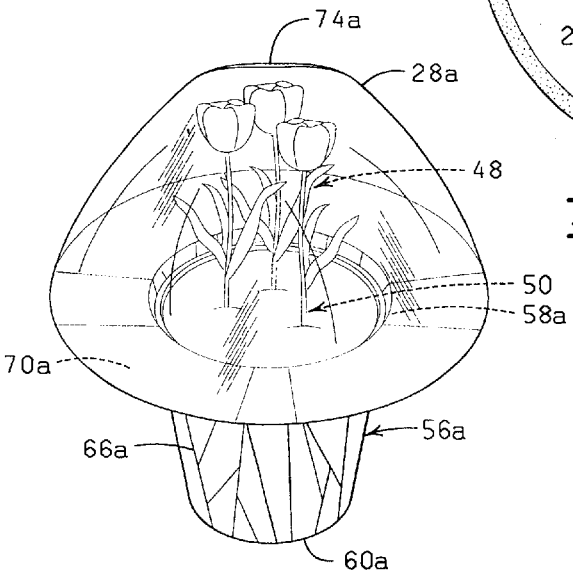

Shown in FIGS. 5 and 6 is a sheet of material 10*a* having a sheet extension 28*a* connected thereto. The sheet of material 10*a* and the sheet extension 28*a* are constructed exactly like the sheet of material 10 and the sheet extension 28 shown in FIGS. 1, 3 and 4 and described in detail before, except the sheet of material 10*a* is circularly shaped having a circularly shaped outer perimeter 24*a* defined by perforation 26*a* and the sheet extension 28*a* is circularly shaped having a circularly shaped outer perimeter 73*a*.

The sheet of material 10*a* is formed into a pot cover 56*a* (FIG. 6) in a manner exactly like that described before with respect to the pot cover 56 (FIGS. 3 and 4), except the pot cover 56*a* has a skirt 70*a* with a circularly shaped appearance and a circularly shaped outer perimeter defined by the circularly shaped outer perimeter 24*a* of the sheet of material 10*a*. The sheet extension 28*a* extends a distance outwardly from the skirt 70*a* and also has a circularly shaped outer perimeter, 73*a* as mentioned before.

The sheet extension 28*a* is formed about the floral grouping 48 in a manner like that described before and secured via the bonding material 72*a* to provide the closed end 74*a*.

Changes may be made in the construction and the operation of the various components, elements and assemblies described herein and changes may be made in the steps or the sequence of steps of the methods described herein without departing from the spirit and scope of the invention as defined in the following claims.

What is claimed is:

1. A covering for use with a pot having a floral grouping disposed therein, the pot having a top, a bottom and a receiving space, and the floral grouping having a stem end and a bloom end, the covering comprising:

a pot cover having a top, a closed bottom, a pot receiving space, and a plurality of overlapping folds, the pot cover sized to extend from the bottom to the top of the pot when the pot is disposed in the pot receiving space of the pot cover;

a skirt extending from the top of the pot cover and having an outer perimeter; and a sheet extension detachably connected to the outer perimeter of the skirt, the sheet extension formable about the floral grouping so as to encompass a substantial portion of the bloom end of the floral grouping, the sheet extension being detachable from the skirt along a plurality of perforations disposed along the outer perimeter of the skirt whereby upon detachment of the sheet extension from the skirt, a decorative cover for the pot having a floral grouping disposed therein is provided.

2. The covering for use with a pot having a floral grouping disposed therein of claim 1 wherein the pot cover and the skirt are constructed of the same sheet of material.

3. The covering for use with a pot having a floral grouping disposed therein of claim 2 wherein the sheet of material from which the pot cover and skirt are constructed is selected from the group of materials consisting of paper, metal foil, natural cloth, synthetic cloth, denim, burlap, polymer film and combinations thereof.

4. The covering for use with a pot having a floral grouping disposed therein of claim 2 wherein the sheet of material from which the pot cover and skirt are constructed has a thickness in a range of from about 0.1 mil to about 30 mil.

5. The covering for use with a pot having a floral grouping disposed therein of claim 1 wherein the sheet extension is constructed of a material selected from the group of materials consisting of paper, metal foil, natural cloth, synthetic cloth, denim, burlap, polymer film and combinations thereof.

6. The covering for use with a pot having a floral grouping disposed therein of claim 5 wherein the material from which the sheet extension is constructed has a thickness in a range of from about 0.1 mil to about 30 mil.

7. The covering for use with a pot having a floral grouping disposed therein of claim 5 wherein the sheet extension is constructed of a material which is transparent.

8. The covering for use with a pot having a floral grouping disposed therein of claim 1 wherein the plurality of overlapping folds of the pot cover are at least partially connected.

9. The covering for use with a pot having a floral grouping disposed therein of claim 1 wherein the sheet extension is further defined as having an upper surface and an outer perimeter, and wherein the sheet extension further includes a bonding material disposed on the upper surface and extending about at least a portion of the outer perimeter of the sheet extension for connecting at least a portion of the outer perimeter of the sheet extension together to provide a closed end.

10. A covering for use with a pot having a floral grouping disposed therein, the pot having a top, a bottom and a receiving space, and the floral grouping having a stem end and a bloom end, the covering comprising:

a pot cover having a top, a closed bottom, a pot receiving space, and a plurality of overlapping folds, the pot cover sized to extend from the bottom to the top of the pot when the pot is disposed in the pot receiving space of the pot cover, and wherein the plurality of overlapping folds are at least partially connected;

a skirt extending from the top of the pot cover and having an outer perimeter; and a sheet extension detachably connected to the outer perimeter of the skirt, the sheet extension formable about the floral grouping so as to encompass a substantial portion of the bloom end of the floral grouping, the sheet extension being detachable from the skirt along a plurality of perforations disposed along the outer perimeter of the skirt whereby upon detachment of the sheet extension from the skirt, a decorative cover for the pot having a floral grouping disposed therein is provided.

11. The covering for use with a pot having a floral grouping disposed therein of claim 10 wherein the pot cover and the skirt are constructed of the same sheet of material.

12. The covering for use with a pot having a floral grouping disposed therein of claim 11 wherein the sheet of material from which the pot cover and skirt are constructed is selected from the group of materials consisting of paper, metal foil, natural cloth, synthetic cloth, denim, burlap, polymer film and combinations thereof.

13. The covering for use with a pot having a floral grouping disposed therein of claim 11 wherein the sheet of material from which the pot cover and skirt are constructed has a thickness in a range of from about 0.1 mil to about 30 mil.

14. The covering for use with a pot having a floral grouping disposed therein of claim 10 wherein the sheet extension is constructed of a material selected from the group of materials consisting of paper, metal foil, natural cloth, synthetic cloth, denim, burlap, polymer film and combinations thereof.

15. The covering for use with a pot having a floral grouping disposed therein of claim 14 wherein the material from which the sheet extension is constructed has a thickness in a range of from about 0.1 mil to about 30 mil.

16. The covering for use with a pot having a floral grouping disposed therein of claim 14 wherein the sheet extension is constructed of a material which is transparent.

17. The covering for use with a pot having a floral grouping disposed therein of claim 10 wherein the sheet extension is further defined as having an upper surface and an outer perimeter, and wherein the sheet extension further includes a bonding material disposed on the upper surface and extending about at least a portion of the outer perimeter of the sheet extension for connecting at least a portion of the outer perimeter of the sheet extension together to provide a closed end.

18. A covering for use with a pot having a floral grouping disposed therein, the pot having a top, a bottom and a receiving space, and the floral grouping having a stem end and a bloom end, the covering comprising:

a pot cover having a top, a closed bottom, a pot receiving space, and a plurality of overlapping folds, the pot cover sized to extend from the bottom to the top of the pot when the pot is disposed in the pot receiving space of the pot cover;

a skirt extending from the top of the pot cover and having an outer perimeter; and a sheet extension detachably connected to the outer perimeter of the skirt, the sheet extension having an upper surface and an outer perimeter and being formable about the floral grouping so as to encompass a substantial portion of the bloom end of the floral grouping, the sheet extension further including a bonding material disposed on the upper surface and extending about the outer perimeter of the sheet extension for connecting at least a portion of the outer perimeter of the sheet extension together to provide a closed end, and the sheet extension being detachable from the skirt along a plurality of perforations disposed along the outer perimeter of the skirt whereby upon detachment of the sheet extension from the skirt, a decorative cover for the pot having a floral grouping disposed therein is provided.

19. The covering for use with a pot having a floral grouping disposed therein of claim 18 wherein the pot cover and the skirt are constructed of the same sheet of material.

20. The covering for use with a pot having a floral grouping disposed therein of claim 19 wherein the sheet of material from which the pot cover and skirt are constructed is selected from the group of materials consisting of paper, metal foil, natural cloth, synthetic cloth, denim, burlap, polymer film and combinations thereof.

21. The covering for use with a pot having a floral grouping disposed therein of claim 19 wherein the sheet of material from which the pot cover and skirt are constructed has a thickness in a range of from about 0.1 mil to about 30 mil.

22. The covering for use with a pot having a floral grouping disposed therein of claim 18 wherein the sheet extension is constructed of a material selected from the group of materials consisting of paper, metal foil, natural cloth, synthetic cloth, denim, burlap, polymer film and combinations thereof.

23. The covering for use with a pot having a floral grouping disposed therein of claim 22 wherein the material from which the sheet extension is constructed has a thickness in a range of from about 0.1 mil to about 30 mil.

24. The covering for use with a pot having a floral grouping disposed therein of claim 22 wherein the sheet extension is constructed of a material which is transparent.

25. The covering for use with a pot having a floral grouping disposed therein of claim 18 wherein the plurality of overlapping folds of the pot cover are at least partially connected.

26. A covering for a pot having a floral grouping disposed therein, comprising:

a pot having a top, a bottom and a receiving space in which a floral grouping is disposed, the floral grouping having a stem end and a bloom end; and a covering disposed about the pot and floral grouping, the covering comprising:

a pot cover having a top, a closed bottom, a pot receiving space, and a plurality of overlappping folds, the pot cover sized to extend from the bottom to the top of the pot disposed in the pot receiving space of the pot cover, a skirt extending from the top of the pot cover and having an outer perimeter, and a sheet extension detachably connected to the outer perimeter of the skirt, the sheet extension formable about the floral grouping so as to encompass a substantial portion of the bloom end of the floral grouping, the sheet extension being detachable from the skirt along a plurality of perforations disposed along the outer perimeter of the skirt whereby upon detachment of the sheet extension from the skirt, a decorative cover for the pot having the floral grouping disposed therein is provided.

27. The covering for a pot having a floral grouping disposed therein of claim 26 wherein the pot cover and the skirt of the covering are constructed of the same sheet of material.

28. The covering for a pot having a floral grouping disposed therein of claim 27 wherein the sheet of material from which the pot cover and the skirt of the covering are constructed is selected from the group of materials consisting of paper, metal foil, natural cloth, synthetic cloth, denim, burlap, polymer film and combinations thereof.

29. The covering for a pot having a floral grouping disposed therein of claim 27 wherein the sheet of material from which the pot cover and the skirt of the covering are constructed has a thickness in a range of from about 0.1 mil to about 30 mil.

30. The covering for a pot having a floral grouping disposed therein of claim 26 wherein the sheet extension of the covering is constructed of a material selected from the group of materials consisting of paper, metal foil, natural cloth, synthetic cloth, denim, burlap, polymer film and combinations thereof.

31. The covering for a pot having a floral grouping disposed therein of claim 30 wherein the material from which the sheet extension of the covering is constructed has a thickness in a range of from about 0.1 mil to about 30 mil.

32. The covering for a pot having a floral grouping disposed therein of claim 30 wherein the sheet extension of the covering is constructed of a material which is transparent.

33. The covering for a pot having a floral grouping disposed therein of claim 26 wherein the plurality of overlapping folds of the pot cover of the covering are at least partially connected.

34. The covering for a pot having a floral grouping disposed therein of claim 26 wherein the sheet extension of the covering is further defined as having an upper surface and an outer perimeter, and wherein the sheet extension further includes a bonding material disposed on the upper surface and extending about at least a portion of the outer perimeter of the sheet extension for connecting at least a portion of the outer perimeter of the sheet extension together to provide a closed end.

35. A covering for a pot having a floral grouping disposed therein, comprising:

a pot having a top, a bottom and a receiving space in which a floral grouping is disposed, the floral grouping having a stem end and a bloom end; and a covering disposed about the pot and floral grouping, the covering comprising:

a pot cover having a top, a closed bottom, a pot receiving space, and a plurality of overlapping folds, the pot cover sized to extend from the bottom to the top of the pot cover, and wherein the plurality of overlapping folds are at least partially connected, a skirt extending from the top of the pot cover and having an outer perimeter, and a sheet extension detachably connected to the outer perimeter of the skirt, the sheet extension formable about the floral grouping so as to encompass a substantial portion of the bloom end of the floral grouping, the sheet extension being detachable from the skirt along a plurality of perforations disposed along the outer perimeter of the skirt whereby upon detachment of the sheet extension from the skirt, a decorative cover for the pot having the floral grouping disposed therein is provided.

36. The covering for a pot having a floral grouping disposed therein of claim 35 wherein the pot cover and the skirt of the covering are constructed of the same sheet of material.

37. The covering for a pot having a floral grouping disposed therein of claim 36 wherein the sheet of material from which the pot cover and the skirt of the covering are constructed is selected from the group of materials consisting of paper, metal foil, natural cloth, synthetic cloth, denim, burlap, polymer film and combinations thereof.

38. The covering for a pot having a floral grouping disposed therein of claim 36 wherein the sheet of material from which the pot cover and the skirt of the covering are constructed has a thickness in a range of from about 0.1 mil to about 30 mil.

39. The covering for a pot having a floral grouping disposed therein of claim 35 wherein the sheet extension of the covering is constructed of a material selected from the group of materials consisting of paper, metal foil, natural cloth, synthetic cloth, denim, burlap, polymer film and combinations thereof.

40. The covering for a pot having a floral grouping disposed therein of claim 39 wherein the material from which the sheet extension of the covering is constructed has a thickness in a range of from about 0.1 mil to about 30 mil.

41. The covering for a pot having a floral grouping disposed therein of claim 39 wherein the sheet extension is constructed of a material which is transparent.

42. The covering for a pot having a floral grouping disposed therein of claim 35 wherein the sheet extension of the covering is further defined as having an upper surface and an outer perimeter, and wherein the sheet extension further includes a bonding material disposed on the upper surface and extending about at least a portion of the outer perimeter of the sheet extension for connecting at least a portion of the outer perimeter of the sheet extension together to provide a closed end.

43. A covering for a pot having a floral grouping disposed therein, comprising:

a pot having a top, a bottom and a receiving space in which a floral grouping is disposed, the floral grouping having a stem end and a bloom end; and a covering disposed about the pot and floral grouping, the covering comprising:

a pot cover having a top, a closed bottom, a pot receiving space, and a plurality of overlapping folds, the pot cover sized to extend from the bottom to the top of the pot disposed in the pot receiving space of the pot cover;

a skirt extending from the top of the pot cover and having an outer perimeter; and a sheet extension detachably connected to the outer perimeter of the skirt, the sheet extension having an upper surface and an outer perimeter and being formable about the floral grouping so as to encompass a substantial portion of the bloom end of the floral grouping, the sheet extension further including a bonding material disposed on the upper surface and extending about the outer perimeter of the sheet extension for connecting at least a portion of the outer perimeter of the sheet extension together to provide a closed end, and the sheet extension being detachable from the skirt along a plurality of perforations disposed along the outer perimeter of the skirt whereby upon detachment of the sheet extension from the skirt, a decorative cover for the pot having the floral grouping disposed therein is provided.

44. The covering for a pot having a floral grouping disposed therein of claim 43 wherein the pot cover and the skirt of the covering are constructed of the same sheet of material.

45. The covering for a pot having a floral grouping disposed therein of claim 44 wherein the sheet of material from which the pot cover and the skirt of the covering are constructed is selected from the group of materials consisting of paper, metal foil, natural cloth, synthetic cloth, denim, burlap, polymer film and combinations thereof.

46. The covering for a pot having a floral grouping disposed therein of claim 44 wherein the sheet of material from which the pot cover and the skirt of the covering are constructed has a thickness in a range of from about 0.1 mil to about 30 mil.

47. The covering for a pot having a floral grouping disposed therein of claim 43 wherein the sheet extension of the covering is constructed of a material selected from the group of materials consisting of paper, metal foil, natural cloth, synthetic cloth, denim, burlap, polymer film and combinations thereof.

48. The covering for use with a pot having a floral grouping disposed therein of claim 47 wherein the material from which the sheet extension of the covering is constructed has a thickness in a range of from about 0.1 mil to about 30 mil.

49. The covering for a pot having a floral grouping disposed therein of claim 47 wherein the sheet extension of the covering is constructed of a material which is transparent.

50. The covering for a pot having a floral grouping disposed therein of claim 43 wherein the plurality of overlapping folds of the pot cover of the covering are at least partially connected.

51. A covering for use with a pot having a floral grouping disposed therein, the pot having a top, a bottom and a receiving space, and the floral grouping having a stem end and a bloom end, the covering comprising:

a pot cover having a top, a closed bottom, a pot receiving space, and a plurality of overlapping folds, the pot cover sized to extend from the bottom to the top of the pot when the pot is disposed in the pot receiving space of the pot cover, and wherein the plurality of overlapping folds are at least partially connected;

a skirt extending from the top of the pot cover and having an outer perimeter; and a sheet extension detachably connected to the outer perimeter of the skirt, the sheet extension having an upper surface and an outer perimeter and being formable about the floral grouping so as to encompass a substantial portion of the bloom end of the floral grouping, the sheet extension further including a bonding material disposed on the upper surface and extending about the outer perimeter of the sheet extension for connecting at least a portion of the outer perimeter of the sheet extension together to provide a closed end, and the sheet extension being detachable from the skirt along a plurality of perforations disposed along the outer perimeter of the skirt whereby upon detachment of the sheet extension from the skirt, a decorative cover for the pot having a floral grouping disposed therein is provided.

52. The covering for use with a pot having a floral grouping disposed therein of claim 51 wherein the pot cover and the skirt are constructed of the same sheet of material.

53. The covering for use with a pot having a floral grouping disposed therein of claim 52 wherein the sheet of material from which the pot cover and skirt are constructed is selected from the group of materials consisting of paper, metal foil, natural cloth, synthetic cloth, denim, burlap, polymer film and combinations thereof.

54. The covering for use with a pot having a floral grouping disposed therein of claim 52 wherein the sheet of material from which the pot cover and skirt are constructed has a thickness in a range of from about 0.1 mil to about 30 mil.

55. The covering for use with a pot having a floral grouping disposed therein of claim 51 wherein the sheet extension is constructed of a material selected from the group of materials consisting of paper, metal foil, natural cloth, synthetic cloth, denim, burlap, polymer film and combinations thereof.

56. The covering for use with a pot having a floral grouping disposed therein of claim 55 wherein the material from which the sheet extension is constructed has a thickness in a range of from about 0.1 mil to about 30 mil.

57. The covering for use with a pot having a floral grouping disposed therein of claim 55 wherein the sheet extension is constructed of a material which is transparent.

58. A covering for a pot having a floral grouping disposed therein, comprising:

a pot having a top, a bottom and a receiving space in which a floral grouping is disposed, the floral grouping having a stem end and a bloom end; and a covering disposed about the pot and floral grouping, the covering comprising:

a pot cover having a top, a closed bottom, a pot receiving space, and a plurality of overlapping folds, the pot cover sized to extend from the bottom to the top of the pot disposed in the pot receiving space of the pot cover, and wherein the plurality of overlapping folds are at least partially connected;

a skirt extending from the top of the pot cover and having an outer perimeter; and a sheet extension detachably connected to the outer perimeter of the skirt, the sheet extension having an upper surface and an outer perimeter and being formable about the floral grouping so as to encompass a substantial portion of the bloom end of the floral grouping, the sheet extension further including a bonding material disposed on the upper surface and extending about the outer perimeter of the sheet extension for connecting at least a portion of the outer perimeter of the sheet extension together to provide a closed end, and the sheet extension being detachable from the skirt along a plurality of perforations disposed along the outer perimeter of the skirt whereby upon detachment of the sheet extension from the skirt, a decorative cover for the pot having the floral grouping disposed therein is provided.

59. The covering for a pot having a floral grouping disposed therein of claim 58 wherein the pot cover and the skirt of the covering are constructed of the same sheet of material.

60. The covering for a pot having a floral grouping disposed therein of claim 59 wherein the sheet of material from which the pot cover and the skirt of the covering are constructed is selected from the group of materials consisting of paper, metal foil, natural cloth, synthetic cloth, denim, burlap, polymer film and combinations thereof.

61. The covering for a pot having a floral grouping disposed therein of claim 59 wherein the sheet of material from which the pot cover and the skirt of the covering are constructed has a thickness in a range of from about 0.1 mil to about 30 mil.

62. The covering for a pot having a floral grouping disposed therein of claim 58 wherein the sheet extension of the covering is constructed of a material selected from the group of materials consisting of paper, metal foil, natural cloth, synthetic cloth, denim, burlap, polymer film and combinations thereof.

63. The covering for a pot having a floral grouping disposed therein of claim 62 wherein the material from which the sheet extension is constructed has a thickness in a range of from about 0.1 mil to about 30 mil.

64. The covering for a pot having a floral grouping disposed therein of claim 62 wherein the sheet extension of the covering is constructed of a material which is transparent.

* * * * *

UNITED STATES PATENT AND TRADEMARK OFFICE

CERTIFICATE OF CORRECTION

PATENT NO. : 6,351,912 B1
DATED : March 5, 2002
INVENTOR(S) : Donald E. Weder

It is certified that error appears in the above-identified patent and that said Letters Patent is hereby corrected as shown below:

Title page,
Item [62], Related U.S. Application Data, should read as follows:
-- This invention is a continuation-in-part of U.S. Ser. No. 968,798, filed Oct. 30, 1992, entitled, "METHOD FOR WRAPPING AN OBJECT WITH A MATERIAL HAVING PRESSURE SENSITIVE ADHESIVE THEREON", which is a continuation of U.S. Ser. No. 865,563, filed May 21, 1992, entitled, METHOD FOR WRAPPING AN OBJECT WITH A MATERIAL HAVING PRESSURE SENSITIVE ADHESIVE THEREON, which is a continuation of U.S. Ser. No. 649,379, filed Jan. 31, 1991, now U.S. Pat. No. 5,111,638, issued May 12, 1992, entitled METHOD FOR WRAPPING AN OBJECT WITH A MATERIAL HAVING PRESSURE SENSITIVE ADHESIVE THEREON, which is a continuation of U.S. Ser. No. 249,761, filed Sep. 26, 1988, now abandoned, which is a continuation-in-part of U.S. Ser. No. 219,083, filed Jul. 13, 1988, now U.S. Pat. No. 4,897,031. issued Jan. 30, 1990 --.

Item [56], References Cited, OTHER PUBLICATIONS, add:
-- 'Color Them Happy with Highlander Products' , 1990,
'Costa Keeps the Christmas Spirit', Supermarket Floral, Sept. 15, 1992,
'Super Seller', Supermarket Floral, Sept. 15, 1992,
'A World of Cut Flower and Pot Plant Packaging' Brochure, Klerk's Plastic Products Manufacturing, Inc., Date unknown, 6 pages,
Chantler & Chantler brochure showing Zipper Sleeve™ and Floarsheet®, Date unknown, 2 pages,
'Derwent Abstract' of FR 2610604A. It is noted that the abstract is an incorrect English translation of the contents of the French patent. The French patent does not enable or disclose adhesively attaching the covering to the container. 1998 --.

Drawings,
Fig. 5, corrections to definitions "24a" and "26a" were added to drawing.

Column 3,
Line 1, word "shape" should be -- shaped --.
Line 47, delete word "surface" after "perimeter".

Column 8,
Line 59, after the word "pot" and before the word "cover" add -- disposed in the pot receiving space of the pot --.

UNITED STATES PATENT AND TRADEMARK OFFICE

CERTIFICATE OF CORRECTION

PATENT NO. : 6,351,912 B1
DATED : March 5, 2002
INVENTOR(S) : Donald E. Weder

It is certified that error appears in the above-identified patent and that said Letters Patent is hereby corrected as shown below:

Column 10,
Line 27, delete the words "use with" after the word "for" and before the words "a pot".

Column 12,
Line 37, after the word "extension" and before the word "is" add -- of the covering --.

Signed and Sealed this

Twenty-fifth Day of November, 2003

JAMES E. ROGAN
*Director of the United States Patent and Trademark Office*

UNITED STATES PATENT AND TRADEMARK OFFICE

CERTIFICATE OF CORRECTION

PATENT NO. : 6,351,912 B1
DATED : March 5, 2002
INVENTOR(S) : Donald E. Weder

It is certified that error appears in the above-identified patent and that said Letters Patent is hereby corrected as shown below:

Drawings,
Delete drawing sheet 1 of 2, and substitute therefore the following drawing sheet consisting of Figs 4, 5 and 6, as shown on the attached page.

Corrections to Fig. 5 in definitions "24a" and "26a" were added to the drawing.

Signed and Sealed this

Thirtieth Day of March, 2004

JON W. DUDAS
*Acting Director of the United States Patent and Trademark Office*

UNITED STATES PATENT AND TRADEMARK OFFICE

CERTIFICATE OF CORRECTION

PATENT NO. : 6,351,912 B1
DATED : March 5, 2002
INVENTOR(S) : Donald E. Weder

It is certified that error appears in the above-identified patent and that said Letters Patent is hereby corrected as shown below:

Title page,
Item [62], Related U.S. Application Data, should read as folows:
-- This invention is a division of application No. 08/183,010, filed on Jan. 14, 1994, which is a continuation of application No. 08/001,001, filed on Jan. 6, 1993, now U.S. Patent No. 5,307,606, which is a continuation-in-part of U.S. Ser. No. 968,798, filed Oct. 30,1992, entitled, "METHOD FOR WRAPPING AN OBJECT WITH A MATERIAL HAVING PRESSURE SENSITIVE ADHESIVE THEREON", which is a continuation of U.S. Ser. No. 865,563, filed May 21, 1992, entitled, METHOD FOR WRAPPING AN OBJECT WITH A MATERIAL HAVING PRESSURE SENSITIVE ADHESIVE THEREON, which is a continuation of U.S. Ser. No. 649,379,filed Jan. 31, 1991, now U.S. Pat. No. 5,111,638, issued May 12, 1992, entitled METHOD FOR WRAPPING AN OBJECT WITH A MATERIAL HAVING PRESSURE SENSITIVE ADHESIVE THEREON, which is a continuation of U.S. Ser. No. 249,761, filed Sep. 26, 1988, now abandoned, which is a continuation-in-part of U.S. Ser. No. 219,083, filed Jul. 13, 1988, now U.S. Pat. No. 4,897,031, issued Jan. 30, 1990 --.

Please delete Column 1, lines 10-11 and substitute therefor:
-- No. 5,307,606 filed Jan. 6, 1993, which is a continuation-in-part of U.S. Serial No. --.

Signed and Sealed this

Twenty-fourth Day of August, 2004

JON W. DUDAS
*Director of the United States Patent and Trademark Office*